US006439934B1

(12) United States Patent
Yu

(10) Patent No.: US 6,439,934 B1
(45) Date of Patent: Aug. 27, 2002

(54) HIGH-SPEED ELECTRICAL CONNECTOR

(75) Inventor: Hung-Chi Yu, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/017,726

(22) Filed: Dec. 14, 2001

(51) Int. Cl.[7] ..... H01R 13/40
(52) U.S. Cl. ..... 439/733.1; 439/857
(58) Field of Search ..... 439/857, 733.1, 439/744, 751, 82, 943

(56) References Cited

U.S. PATENT DOCUMENTS 3,621,444 A * 11/1971 Stein ..... 439/733.1
6,171,126 B1 * 1/2002 Wu et al. ..... 439/733.1

* cited by examiner

*Primary Examiner*—Tho D. Ta
(74) *Attorney, Agent, or Firm*—Wei Te Chung

(57) ABSTRACT

An electrical connector (100) for mounting on a PCB (3) includes an insulative housing (1) with a plurality of passageways (13) defined therethrough for receiving a corresponding plurality of electrical contacts (2) therein. Each passageway has indentations (136) forming downwardly facing stopping surfaces (137) in one inner wall of the passageway towards a bottom surface (12) of the housing. Each electrical contact has a retaining portion (24) confronting the stopping surface of the passageway. The contacts are retained in position by the stopping surface when the connector is mounted to the PCB.

2 Claims, 5 Drawing Sheets

HIGH-SPEED ELECTRICAL CONNECTOR

BACKGROUND OF THE INVENTION

1. Field of the Invention

The present invention relates to the art of electrical connectors, and more particularly to a high-speed electrical connector having retention mechanism for retaining contacts in a housing of the connector.

2. Description of the Prior Art

A conventional high-speed electrical connector 500 commonly has a plurality of electrical contacts 52 as shown in FIGS. 4–5, each of which has a press-fit retaining portion 524. When the connector 5 is mounted to a printed circuit board (PCB) 53, the retaining portions 524 of the contacts 52 are inserted into through holes 531 in the PCB 53. Each through hole 531 has a diameter less than a dimension of the retaining portion 524. The connector 500 can be mounted on the PCB 53 by pressing the retaining portions 524 of the contacts 52 into the through holes 531 without additional soldering process.

When the connector 5 is mounted to the PCB 53, the retaining portions 524 of the contacts 52 confront sidewalls of the PCB 53 around the through holes. The contacts 52 are retained in passageways 513 of the housing 51 by barbs 523 protruding from opposite sides of each contact 52. However, the barbs 523 are insufficient to securely retain the contacts 52 in the passageways 513 if the insertion force during the mating process is too high. The contacts 52 will slide upwardly along the passageways 513 as the housing 51 is pressed toward the PCB 53, which leads to the contacting portion 521 of the contacts 52 resisting an inner face 518 of a top wall of the housing 51. Under such condition, the contacting portions 521 will bias from their proper position, thereby failing to electrically connect with corresponding contacts of a mating connector (not shown). In addition, the insertion force acted on the retaining portion 524 of the contact 52 may subject the retaining portion 524 to a force in a direction perpendicular to the insertion direction which alters the pitch of the contacts thereby adversely affecting insertion of the contacts 52 into the holes 531 defined in the PCB 53.

Therefore, an improved connector and compliant contacts are required having an improved retention mechanism for retaining the contacts within a housing of the connector without undue deformation of the contacts.

SUMMARY OF THE INVENTION

Accordingly, an object of the present invention is to provide an improved connector with contacts having retaining mechanisms for positioning the contacts in true positions when the connector is mounted to a PCB.

In order to achieve the object set forth, an electrical connector in accordance with the present invention includes an insulative housing defining a plurality of passageways therethrough and a plurality of contacts received in the passageways. Each passageway has an indentation in an inner wall thereof forming a downwardly facing stopping surface. Each contact has a base portion and a pair of arm portions received in the passageway of the housing and a press-fit tail portion extending downwardly from the bottom surface of the housing. A retaining portion is defined between the base portion and the tail portion. Each retaining portion has a pair of retaining arms extending from opposite ends of the retaining portion and resisting against the stopping surface of the indentation of the passageway. Thus, when the contacts of the connector are inserted into through holes in a PCB, the contacts are prevented by the indentations from sliding upwardly along the passageways.

Other objects, advantages and novel features of the present invention will be drawn from the following detailed description of a preferred embodiment of the present invention with attached drawings, in which:

DESCRIPTION OF THE PREFERRED EMBODIMENT

Reference will now be made in detail to the preferred embodiment of the present invention.

Figure 1:
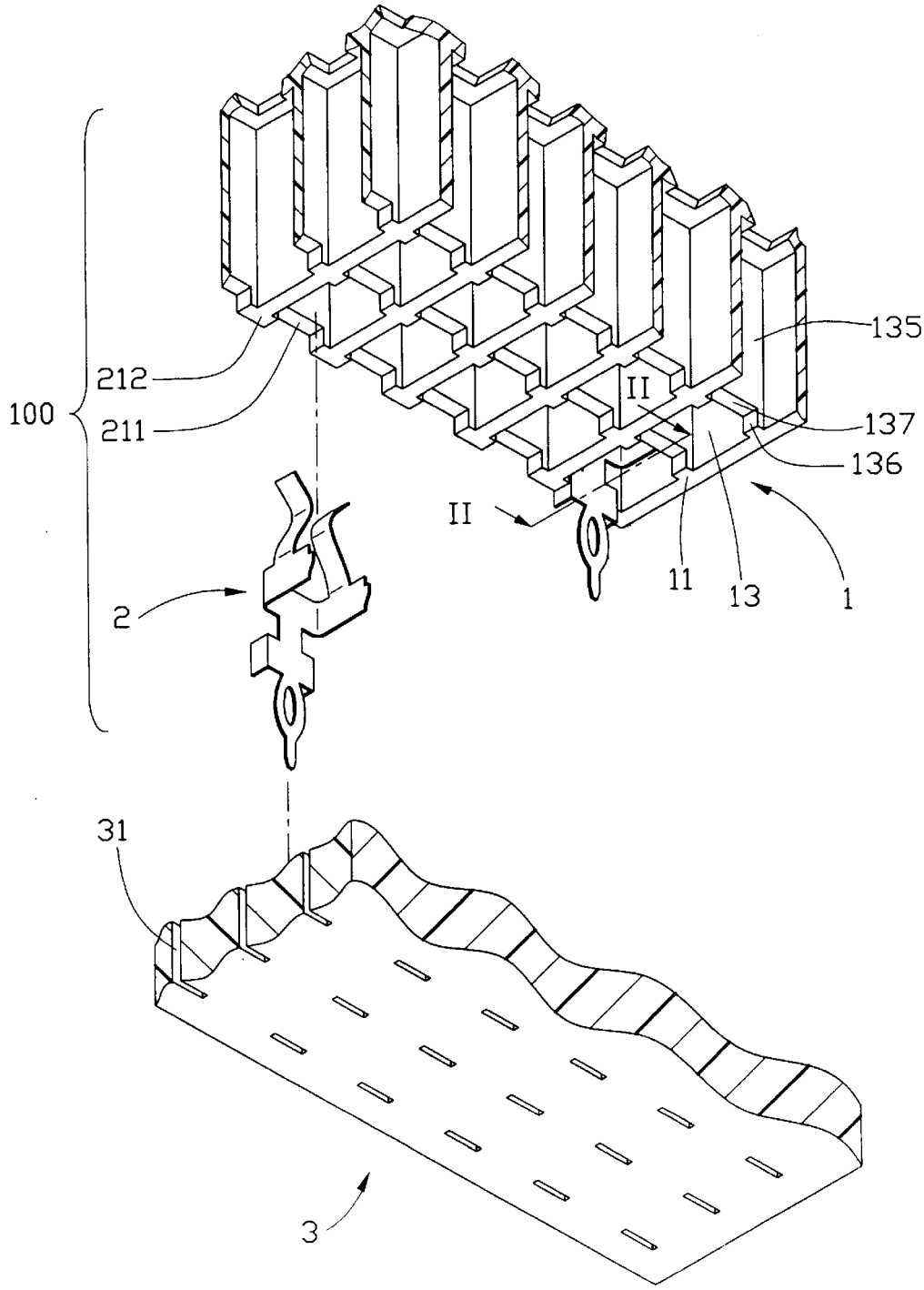
FIG. 1 is an exploded view of an electrical connector in accordance with the present invention together with a PCB.

Referring to FIG. 1, an electrical connector 100 in accordance with a preferred embodiment of the present invention includes an insulative housing 1 and a plurality of electrical contacts 2 received in the housing 1.

Figure 2:
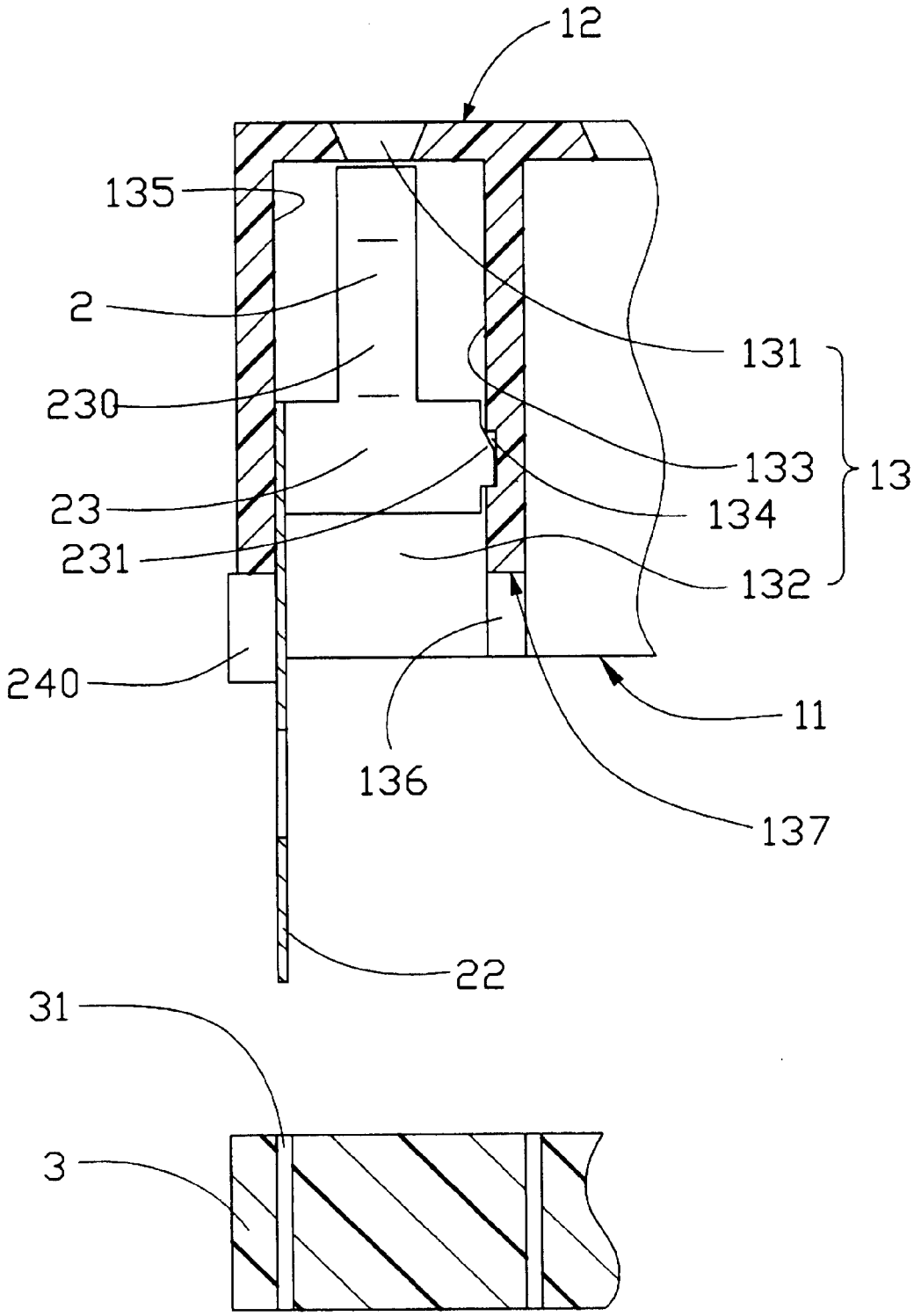
FIG. 2 is a cross-sectional view of the electrical connector, taken along line II—II of FIG. 1.

Referring particularly to FIG. 2, the housing 1 of the connector 100 has a mounting bottom surface 11 for mounting onto the PCB 3, a mating top surface 12 for mating with a mating connector (not shown), and a plurality of passageways 13 extending through the top and bottom faces 12, 11 for receiving a plurality of contacts 2 therein. Each passageway 13 has an opening 131 in the top surface 12 of the housing 1 and a receiving room 132 adjacent to the opening 131 and extending downwardly throughout the bottom surface 11. A first inner wall 133 of the receiving room 132 has a pair of recesses 134 concaved therein. The first inner wall 133 and a second inner wall 135 opposing the first inner wall 133 each form an indentation 136 which has a downwardly facing stopping surface 137 near the bottom surface 12 of the housing 1.

Figure 3:
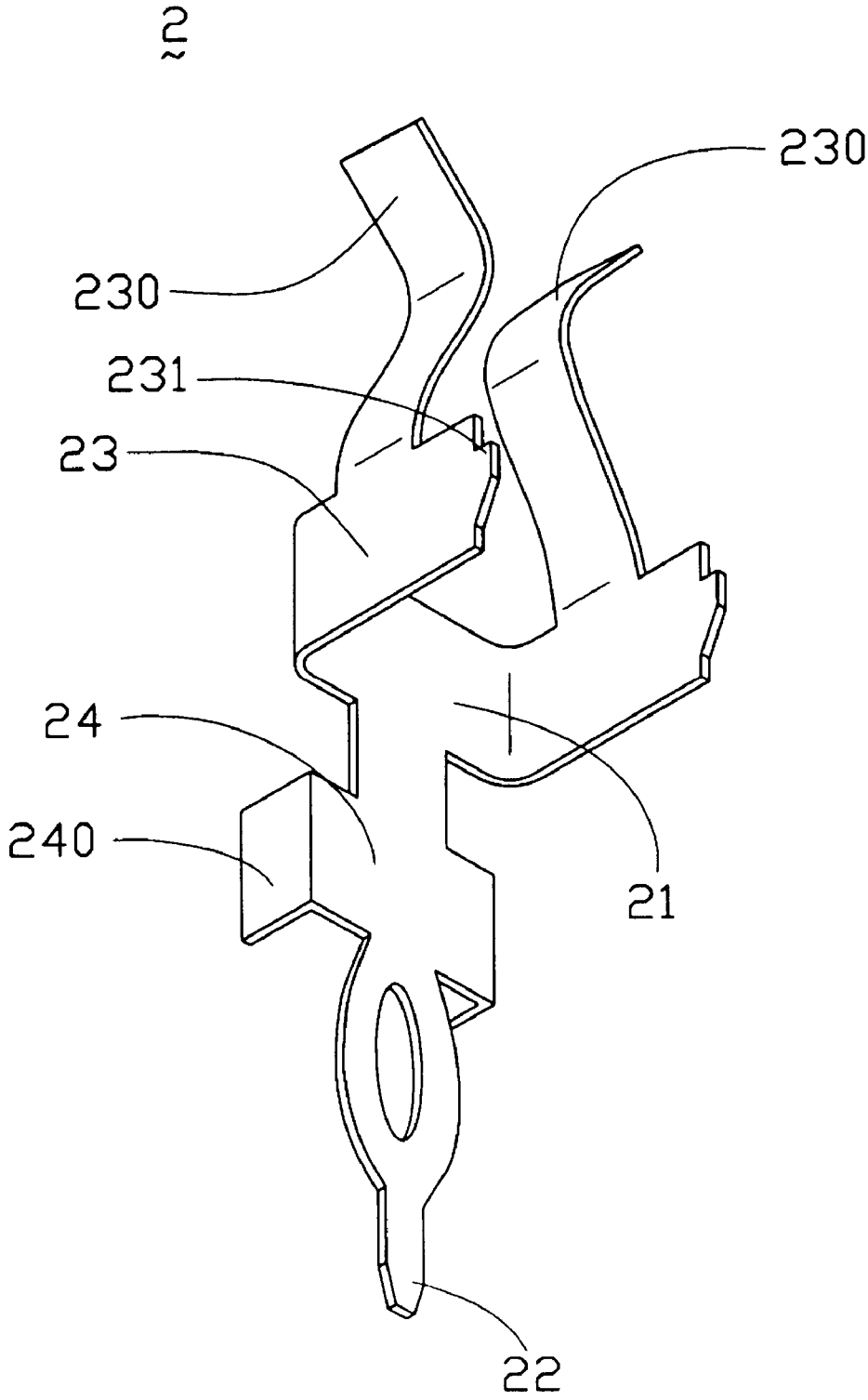
FIG. 3 is a perspective view of a contact of the electrical connector of FIG. 1.
Figure 4:
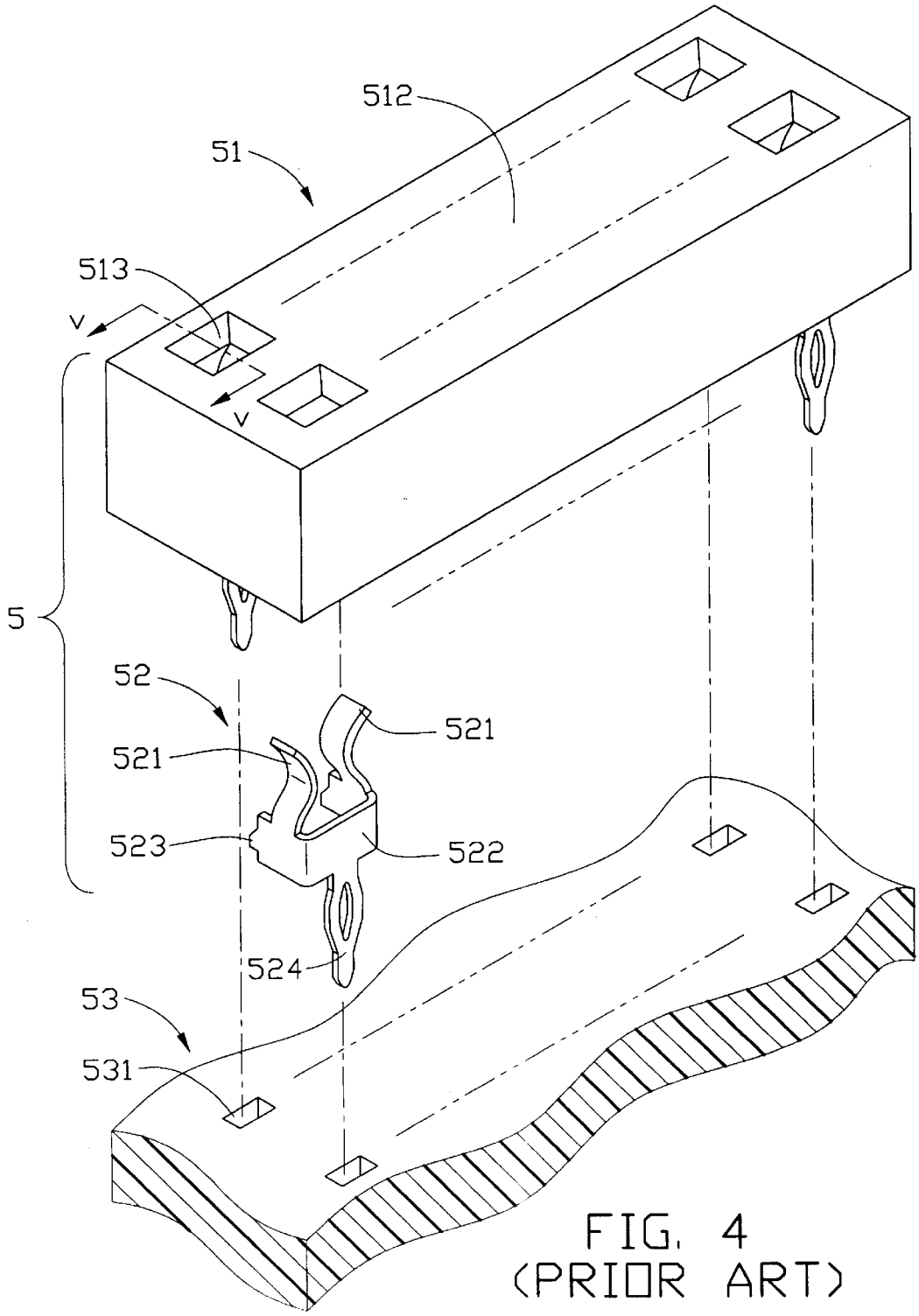
FIG. 4 (PRIOR ART)
FIG. 4 is an exploded view of a conventional electrical connector together with a PCB.
Figure 5:
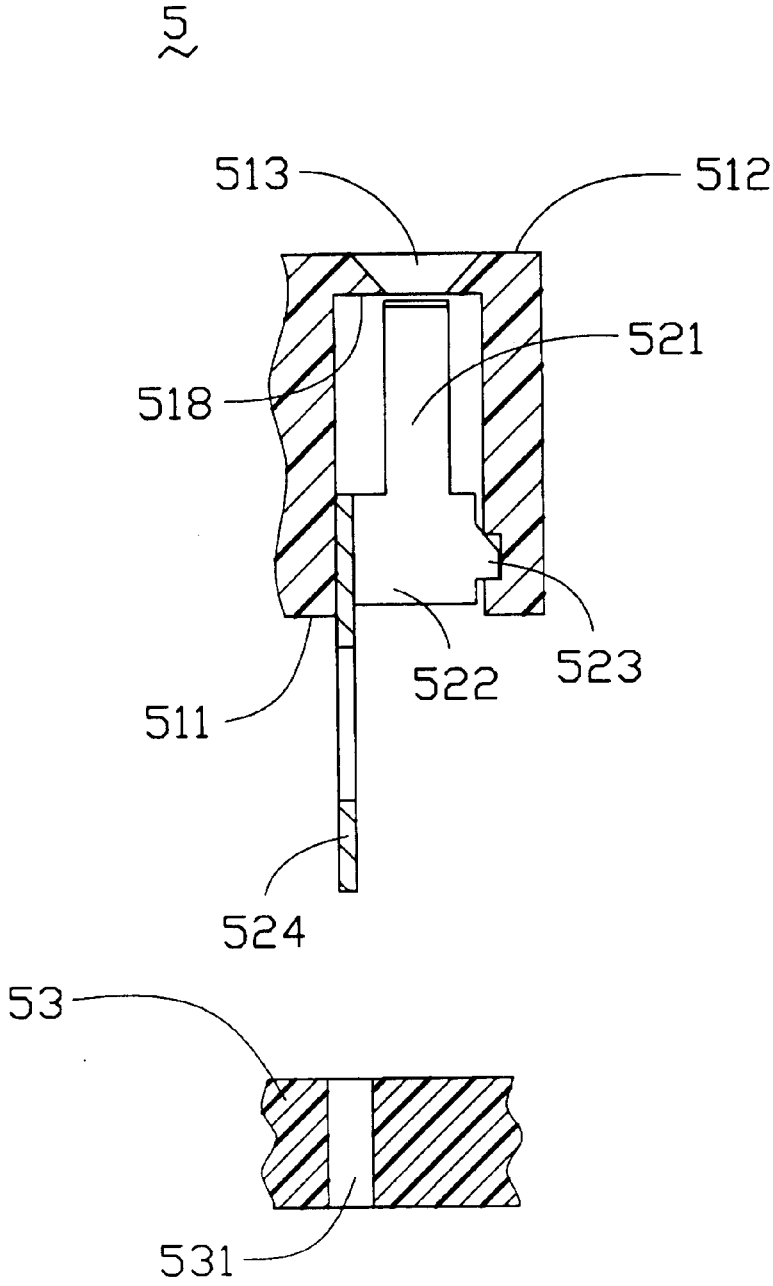
FIG. 5 (PRIOR ART)
FIG. 5 is a cross-sectional view of the connector and the PCB taken along line V—V of FIG. 4.

Referring particularly to FIG. 3, each contact 2, formed by stamping, includes a base portion 21, a press-fit tail portion 22 extending downwardly from a lower edge of the base portion 21, a pair of arm portions 23 extending perpendicularly from opposite ends of the base portion 21. The pair of arm portions 23 each have a spring contacting portion 230 extending upwardly for engaging with a corresponding plug contact (not shown), and a barb portion 231 protruding from a free end thereof for securing into the corresponding recess 134 of the housing 1. A retaining portion 24 is defined between the base portion 21 and the tail portion 22 and comprises a pair of retaining arms 240 extending vertically from opposite ends of the retaining portion 24. The barb portion 231 and the retaining arms 240 are located at opposite sides of the contacting portion 230.

Referring to FIG. 2 again, the contacting portions 230 and the base portion 21 of each contact 2 are accommodated in the receiving room 13, the tail portion 22 extends out from the passageway 13, and the two barb portions 231 are respectively received in the recesses 134. The retaining arms 240 of each contact 2 are located in the indentation 136 of the housing 1 and abut against the stopping surface 137 of the indentation 136.

The connector 100 is mounted to the PCB 3 with the tail portion 22 of the contacts 2 being inserted into the through holes 31 of the PCB 3. Since the through holes 31 are smaller than the tail portions 22, the contacts 2 are subject to an upward force tending to force the contacts 2 to slide upwardly. The contacts 2 are retained in position in a way that the retaining portions 24 are stopped by the stopping surface 137 of the indentation 136 and the barb portions 231 locked in the recess 133. Moreover, the barb portion 231 and the retaining arms 240 are located at opposite sides of the contacting portion 230 so that the force is completely counteracted by the recess 134 and the stopping surface 137, thereby preventing the contacts 2 from rotation and upward movement.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board (PCB), comprising:

an insulative housing having a top surface, a bottom surface and a plurality of passageways extending from the bottom surface to the top surface, each passageway having indentations defined near the bottom surface and forming downwardly facing stopping surfaces;

a plurality of contacts fixed in the housing, each contact having a base portion, a pair of arm portions defined at opposite ends of the base portion, a tail portion extending downwardly from the base portion for mounting on the printed circuit board, and a retaining portion defined between the base portion and the tail portion and having a pair of retaining arms bent from opposite ends of the retaining portion, the retaining arms and the arm portions being located at opposite sides of the base portion;

wherein the retaining arms of the contacts are located in the indentations and confront the stopping surfaces of the indentations whereby the retaining arms press against the indentations when the connector is mounted to the PCB;

wherein the retaining arms of each contact are perpendicular to a corresponding tail portion; and wherein each arm portion has a spring contacting portion extending upwardly from an upper edge thereof and a barb portion protruding laterally from a free end thereof, the barb portion being received in a corresponding recess of the passageway.

2. An electrical connector comprising:

an insulative housing defining a plurality of passageways extending therethrough in a vertical direction;

each of said passageways formed by surrounding faces and defining an indentation in one of said surrounding faces and around a bottom surface of the housing;

a plurality of contacts respectively received within the corresponding passageways, respectively;

each of said contacts including a vertical base portion abutting against said one of the surrounding faces, a barb portion and a resilient contacting portion extending from an upper portion of the base portion in the corresponding passageway;

a stop portion formed around a bottom portion of the base portion and located in said indentation;

a tail portion downwardly extending from the bottom portion of said base portion for mounting on a printed circuit board; and Wherein the barb portion horizontally extends in one direction to cross the corresponding passageway, while the stop portion horizontally extends in another direction opposite to said direction.

* * * * *